US005746290A

United States Patent [19]

St-Germain et al.

[11] Patent Number: 5,746,290

[45] Date of Patent: May 5, 1998

[54] SELF ERECTING SCAFFOLDING

[75] Inventors: André St-Germain, St-Bonaventure; Luc Tessier, Drummondville, both of Canada

[73] Assignee: Gestion De Brevets Fraco Ltée, Québec, Canada

[21] Appl. No.: 507,885

[22] Filed: Jul. 27, 1995

[51] Int. Cl.[6] ..... E04G 1/20

[52] U.S. Cl. ..... 182/146; 182/130

[58] Field of Search ..... 182/145, 141, 182/146, 130

[56] References Cited

U.S. PATENT DOCUMENTS 4,809,814 3/1989 St-German ..... 182/146

5,579,865 12/1996 Butler ..... 182/146

*Primary Examiner*—Alvin C. Chin-Shue

*Attorney, Agent, or Firm*—Francois Martineau

[57] ABSTRACT

A work platform is supported by a sleeve which is movable along a tower having a plurality of vertically equally spaced rungs. The raising system of the invention comprises two hydraulic rams pivotably attached to the sleeve and equipped with corresponding hooks at the extremity of their piston rods. The rams are activated simultaneously in up and down movement but in alternate directions, bearing in a hooking engagement in turn on the rungs of the tower to pull the sleeve upwards along the tower. When a rung is in the path of a hook in the upward movement, the latter pivots backwards to clear the rung and is pivoted back by means of springs. The lowering operation of the sleeve is done similarly to the raising operation, but there is provided latch levers that an operator must unlatch to allow springs to pivot the hooks in a rung clearing position during the retraction of the corresponding ram's piston rod, so that the hook will clear the rungs; only at the end of the retraction operation is the hook pivoted back to a rung engaging position. The raising system further comprises a toothed rack corresponding and rigidly linked to each hook, the racks engaging peripherally a complementary gear wheel on opposite sides of the latter for synchronizing the movement of the piston rods. There is also provided a security braking system, for preventing the sleeve from falling along the tower. The braking system comprises a rocking arm pivotable between a rung engaging and a rung clearing position, and a retainer arm for retaining the rocking arm in the rung clearing position. There is a finger pivotably attached to the retainer arm which will hit each successive rung and pivot to clear them, if the sleeve is lowered at a normal rate. If the sleeve is to fall rapidly, the finger will hit a rung at high speed and pivot the retainer arm, therefore making the rocking arm pivot into the rung engaging position by means of springs. The rocking arm will then abut against a rung and prevent the sleeve from falling.

15 Claims, 11 Drawing Sheets

Fig.14
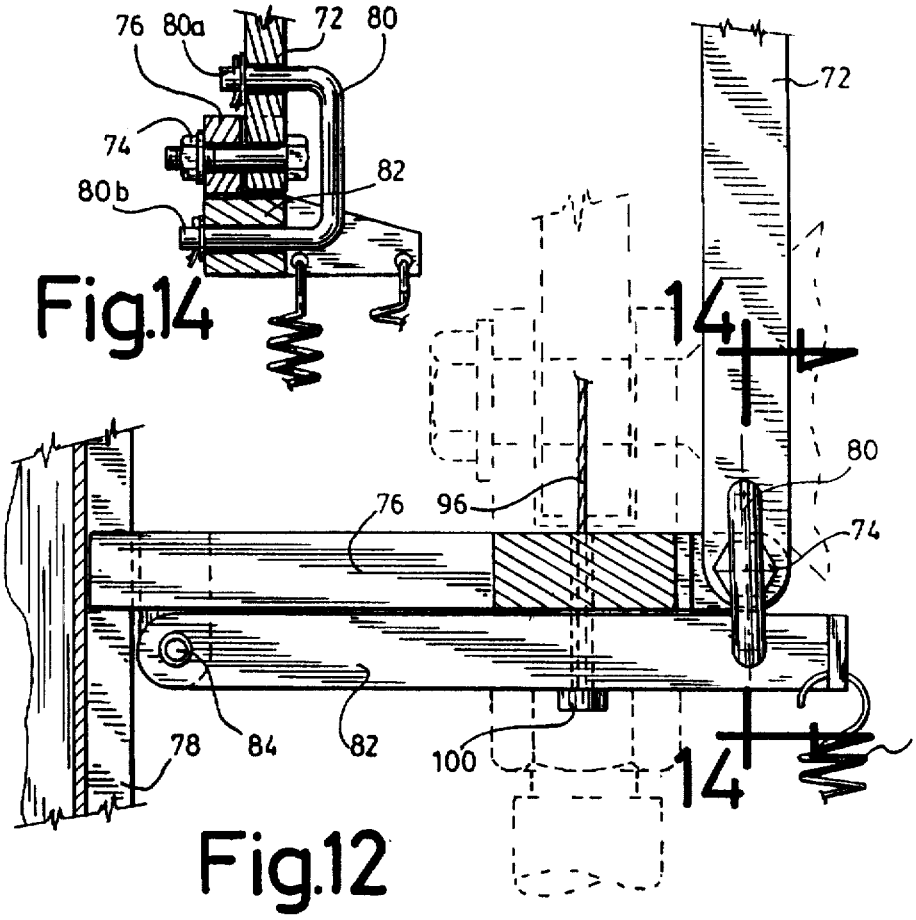
Fig.12
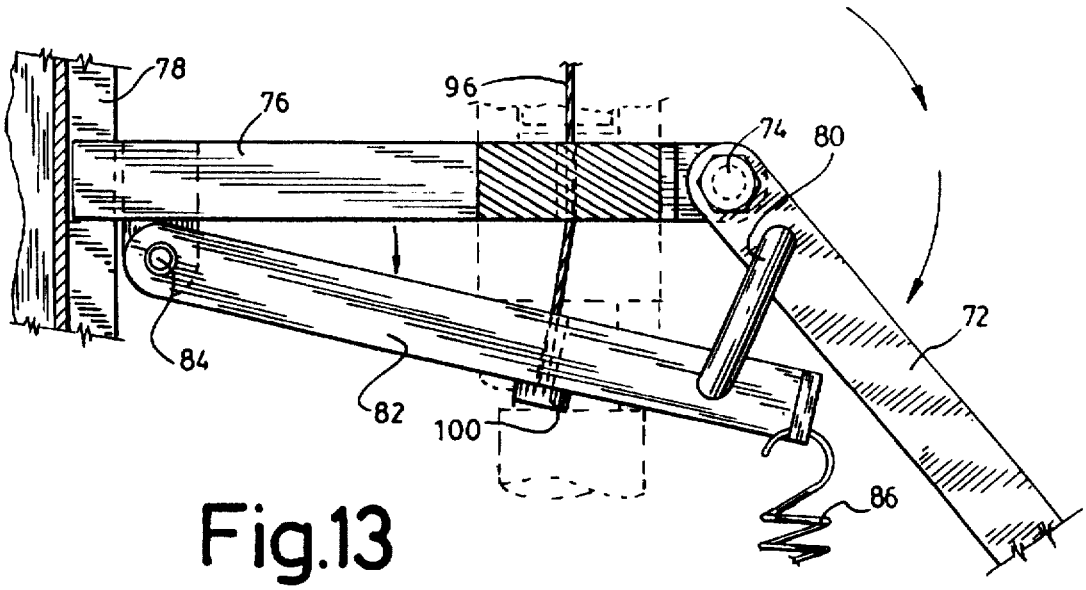
Fig.13

SELF ERECTING SCAFFOLDING

FIELD OF THE INVENTION

The present invention relates to self raising platform assemblies, and more particularly to the means for raising such platforms.

BACKGROUND OF THE INVENTION

U.S. Pat. No. 4,809,814 issued in 1989 to JEAN ST-GERMAIN shows a scaffolding with a platform raising system (FIG. 7) comprising an arm 84 and a ram member 106 that work together to raise (or lower) the platform 42. The platform 42 is vertically movable along an upstanding post 30 and is symmetrically positioned thereon. To raise platform 42, ram member 106 upwardly extends its piston rod 112 which slidably and pivotably engages, with its upper end, successive transverse bars or steps 38 of post 30. A guide bar 120 is provided to slidably engage each successive step 38 and prevent piston rod 112 from abutting against the lower portion of said steps. When its stroke is complete, piston rod 112 is retracted by its cylinder 108 and downwardly abuts with a hook member 118 against a step 38; therefore, when its stroke is reversed, ram member 106 raises platform 42. Arm 84 engages with a hook member 90 steps 38 on the opposite side of post 30, while ram member 106 is in its upward stroke, to uphold platform 42. Arm 84 is pivotable and is also equipped with a guide bar 98 to clear each successive step 38 as platform 42 is raised by ram member 106. Piston rod 112 has an upward stroke allowing it to move two steps at a time, to accelerate the raising of the platform. To lower the platform, however, an operator must manually pivot arm 84 (and a second security arm 84') to allow them to clear each successive step 38.

U.S. Pat. No. 5,368,125 issued in 1994 to the present applicant shows another platform raising system for raising a work platform 24 along a tower 2. FIGS. 9 to 20 show different embodiments of the raising system, though the idea is essentially the same in each embodiment. FIG. 9 shows that the platform raising system comprises two power actuated hydraulic rams 36 each having a hook member 50 pivotably installed at the upper end of their piston rod. Biasing means 54, 56, 60, 62 link the hook members 50 of the two rams 36 in an opposite simultaneous pivoting movement, so that hooks 50 may pivotably engage or clear the bars or rungs of the tower frame structure (as in the JEAN ST-GERMAIN patent). To raise the work platform to which the lower part of rams 36 are attached, the latter extend their piston rod upwardly. The inclined surfaces 70 of hooks 50 slidably engage each successive rungs 10 of the tower frame structure to pivot hooks 50 and allow them to clear each of said rungs 10. A spring 62 pivots hooks 50 inwardly so that they may engage a corresponding step 10 once a rung 10 is cleared. When the downward stroke of rams 36 is initiated, hooks 50 therefore downwardly abut against, in a hooking engagement, steps 10 and the retraction of the rams' piston rods results in the raising of the work platform. During the upward stroke of rams 36, latching levers 72 abut against steps 10 to sustain the work platform (FIG. 9*a*). Levers 72 can pivot to clear each successive step 10 while they are raised with the work platform during the upward stroke of rams 36. During the lowering of the platform, an operator must manually pivot latching levers 72 to their rung unlatching position in which the platform may be lowered without hindrance to the platform lowering operation.

Both of the previously mentioned patents thus include a work platform which can be raised (or lowered) along a single tower through the instrumentality of powered rams that pull the work platform by hooking themselves on successive rungs of the tower. These patents are functional, though the raising or lowering of the platform is a relatively slow operation. Also, an operator is needed to manually pivot the arm 84 (in the JEAN ST-GERMAIN patent) or the latching levers 72 (in the ANDRE ST-GERMAIN patent) to allow the lowering of the work platform. Moreover, it is important that the separate arms (either the arm 84 and the ram 106 of the JEAN ST-GERMAIN patent or the two rams 36 of the ANDRE ST-GERMAIN patent) used in the platform raising operation be in perfect registration with one another, i.e. that one of them abut on a tower rung while the other is in its extension stroke, else the platform could fall (to be stopped by the safety brake, of course, but occasioning problems anyhow).

OBJECTS OF THE INVENTION

It is an object of this invention to provide a self raising system for a work platform.

It is another object of this invention that the raising system be faster that the existing systems.

It is yet another object of this invention that the platform lowering operation be accomplished without the constant implication of an operator.

Another object of the invention is that the system of the character described be fail-safe.

SUMMARY OF THE INVENTION

The present invention relates to a platform raising system in a scaffolding for raising a work platform along a tower, said platform being sustained by a sleeve member positioned around said tower, almost encircling it completely, said sleeve member being movable along said tower, said tower having a plurality of approximately parallel and equally spaced rungs, said raising system being installed on said sleeve member, said raising system comprising two rams pivotably attached to said sleeve member and having piston rods movable from a retracted position to an extracted position and at the end of which are pivotably installed corresponding hook members, said rams being connected to power means and control means that simultaneously activate each ram in up and down movement but in alternate directions, first pivoting means for pivoting said hook members from a hooking position to an unhooking position under the action of said rams, said raising system further comprising synchronizing means for synchronizing the relative movement of said rams, at least one of said hook members abutting against one of said rungs in said hooking position at any given time to sustain said sleeve member.

Preferably, said sleeve member is raised or lowered of a distance approximately equal to twice the distance between two successive rungs under the action of said rams, the strokes of said rams being at least equal to slightly more than the distance between two successive rungs.

Advantageously, said first pivoting means are inclined surfaces on said hook members, said inclined surfaces being slidably engageable with each successive rung to pivot said hook members in said unhooking position.

Preferably, said hook members have biasing means for pivoting them from said unhooking position to said hooking position when said inclined surface is not in contact with one of said rungs.

Advantageously, said platform raising system comprises second pivoting means for pivoting said hook members from said hooking position to said unhooking position, said second pivoting means comprising a latch lever member pivotable between a latched position and an unlatched position, said second pivoting means being gradually activated during the extension stroke of said rams from an inactive position when said piston rods are in said retracted position, said second pivoting means pivoting one of said hook members only if: a) said hook member is not bearing on any one of said rungs in a hooking engagement; and b) said latch lever member is in said unlatched position.

Preferably, a latch handle is provided to manually force said latch lever member into said latched position or into said unlatched position.

Advantageously, said second pivoting means further comprise at least one spring for each of said rams, said spring being attached to a corresponding one of said hook members at its first extremity and to said sleeve member at its second extremity, said spring being at its equilibrium state when said corresponding piston rod is in said retracted position.

Preferably, said hook members have biasing means for pivoting them from said unhooking position to said hooking position when said second pivoting means are not pivoting them into said unhooking position.

Advantageously, said synchronizing means are a pair of parallel toothed racks engaging peripherally a complementary gear wheel on opposite sides of the latter, each one of said racks being rigidly linked to a corresponding one of said hook members.

Preferably, said platform raising system further comprises a security braking system, said braking system to be activated only if said sleeve member moves generally downwardly along said tower at a specific speed or faster, said specific speed being considerably faster than the speed at which the sleeve member is destined to move along said tower during its use.

Advantageously, said braking system comprises a rocking member pivotable between a rung engaging and a rung clearing position, a retainer arm pivotable between a first and a second limit position, said retainer arm retaining said rocking member in said rung clearing position when it is in said first limit position, biasing means for pivoting said rocking member in said rung engaging position when said retainer arm is in said second limit position and a finger member for pivotable abutment against each of said successive rungs, said finger member pivoting on itself when the speed of said sleeve member is lower than said specific speed and pivoting said retainer arm from said first limit position to said second limit position when the speed of said sleeve member is greater than said specific speed.

DESCRIPTION OF THE DRAWINGS

In the annexed drawings:

FIG. 12 is a partial cross-sectional view, at an enlarged scale, taken along line 12—12 of FIG. 8;

FIG. 13 is similar to FIG. 12, but showing the latching lever member in its unlatched position;

FIG. 14 is a partial cross-sectional view taken along line 14—14 of FIG. 12;

DETAILED DESCRIPTION OF THE EMBODIMENTS

Figure 1:
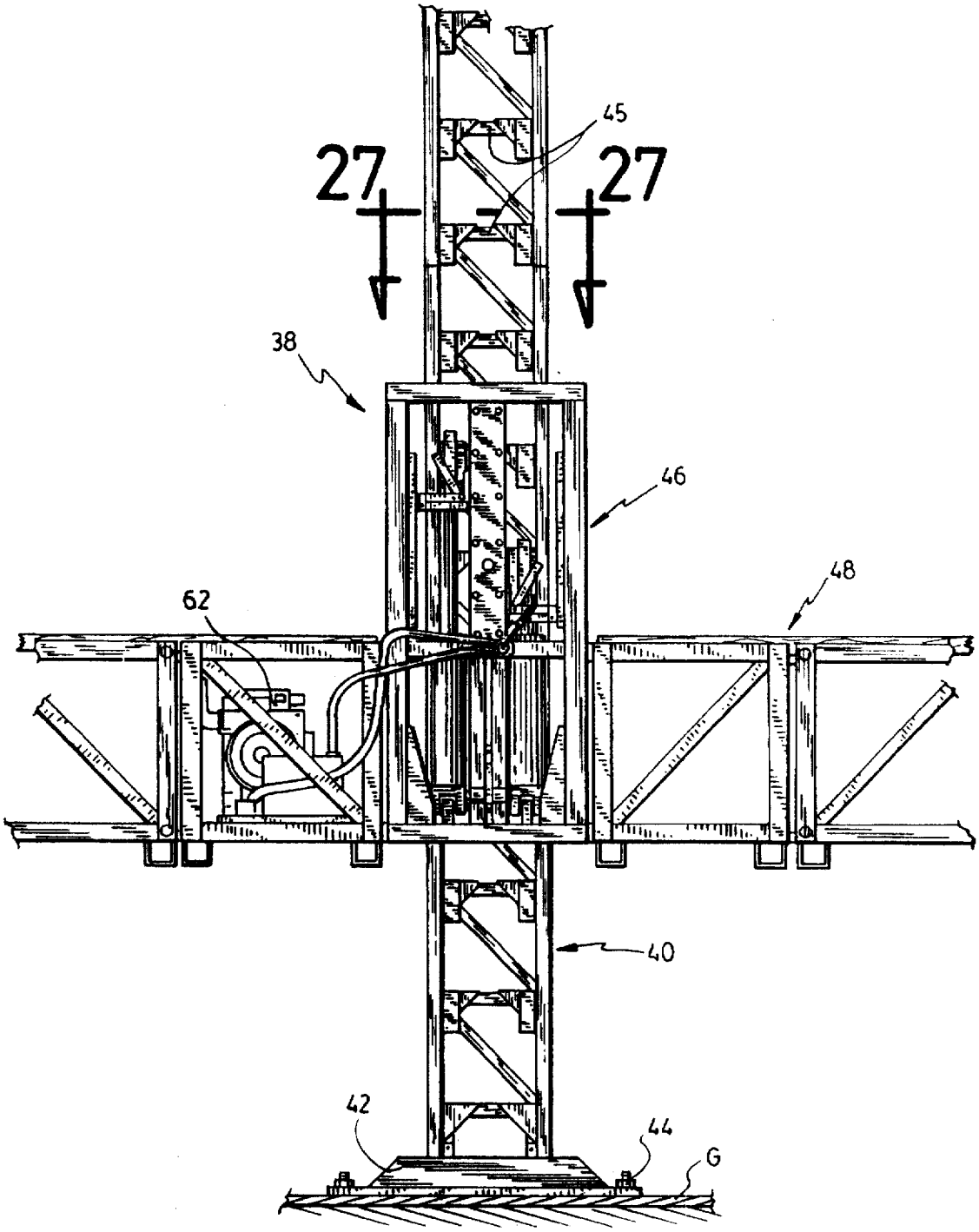
FIG. 1 is a partial elevation of a tower and work platform assembly together with a platform raising system according to the invention.

FIG. 1 shows a scaffolding 38 comprising a tower 40 which rests on—and is attached to—a base 42 securingly anchored to the ground G. e.g. with bolts 44. Tower 40 is of the type described in the above-mentioned JEAN ST-GERMAIN patent, except for a few improvements which will be described later, and comprises inter alia a plurality of generally horizontal and vertically equally spaced rungs 45. Tower 40 is secured to the wall (not shown) of the structure on which work is done and is spaced therefrom through the instrumentality of a plurality cross bars (not shown, but refer to the JEAN ST-GERMAIN patent). A sleeve member 46 is movable along tower 40, sleeve member 46 having a rectangular cross-section (FIG. 23) and being positioned around tower 40, almost encircling it completely. Sleeve member 46 has a vertical opening 47 allowing it to move along tower 40 without hindrance from the cross bars. A work platform (FIG. 1) 48 is removably attached to sleeve member 46 in a manner which will also be described later.

Figure 2:
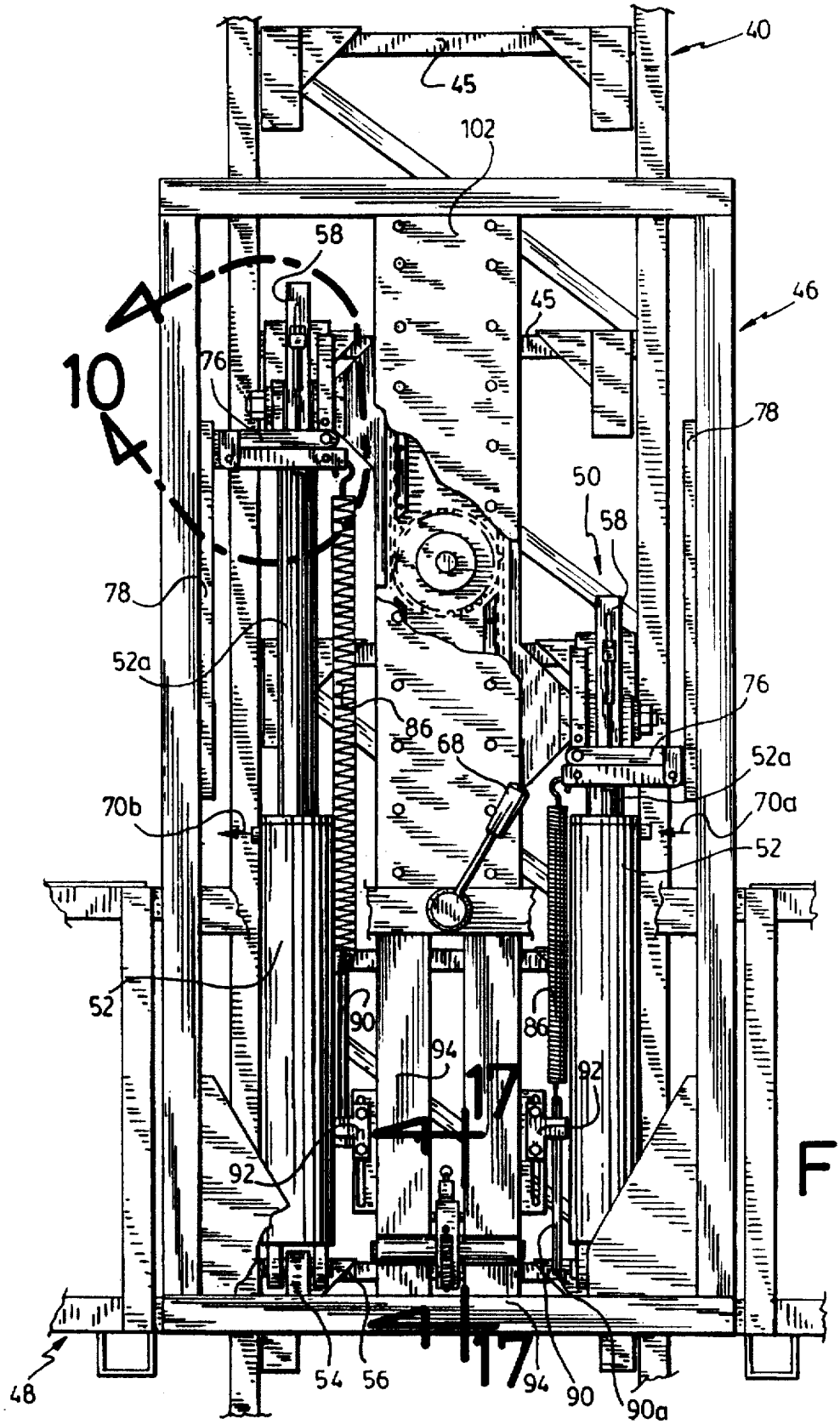
FIG. 2 is a partially fragmented elevation, at an enlarged scale, of the platform raising system of FIG. 1, partially showing the tower and work platform.

FIG. 2 shows a platform raising (and lowering) system 50 according to the invention. Raising system 50 comprises two powered rams 52, 52 that are hingedly attached, at the lower end of their cylinder, to sleeve member 46 through the instrumentality of ears 54 and bolts 56.

Each ram 52 has a hook member 58 (FIGS. 2 and 6 to 9) pivotably attached at the free end of its piston rod 52*a* by a hook bolt 59. Hook member 58 has an inclined upper surface 60.

Figure 9:
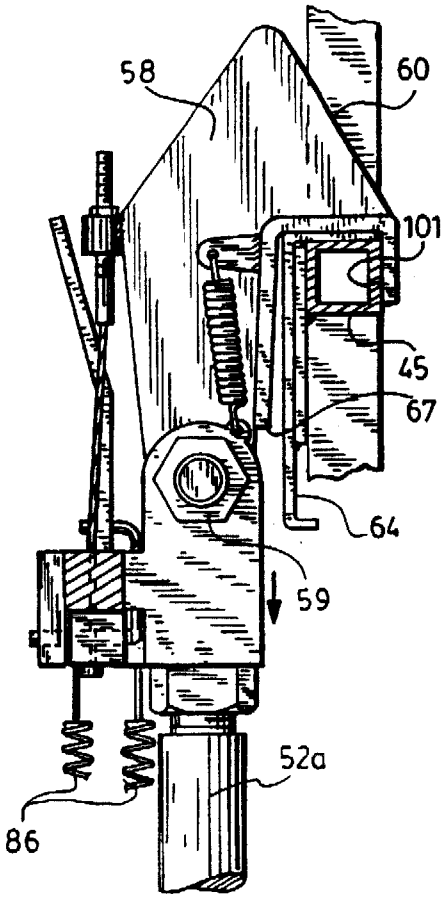
FIG. 9 on the fourth sheet of drawings, is similar to FIGS. 6 to 8, but showing the hook member at a different position.
Figure 7:
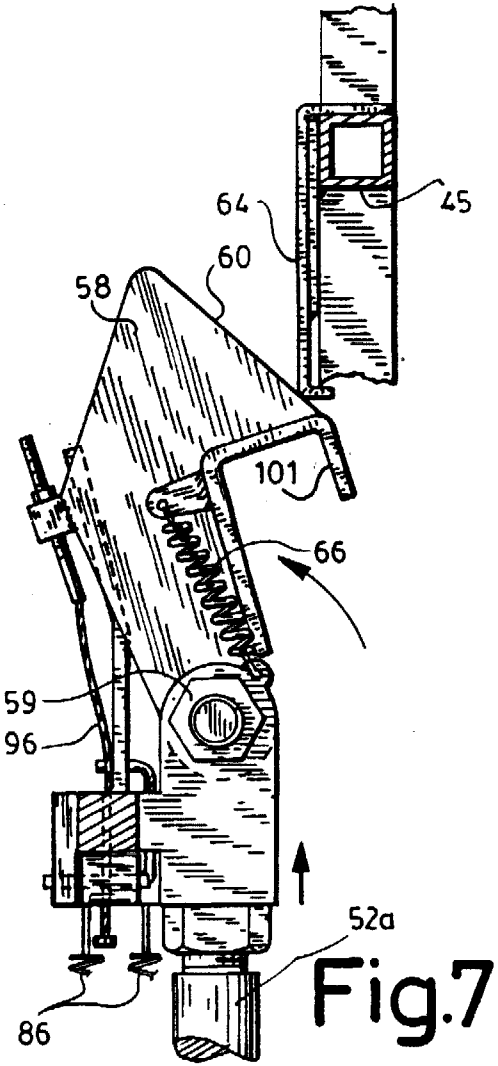
FIGS. 6 to 8 are cross-sectional views, at an enlarged scale, taken along lines 6—6, 7—7 and 8—8 of FIGS. 3, 4 and 5, respectively.
Figure 8:
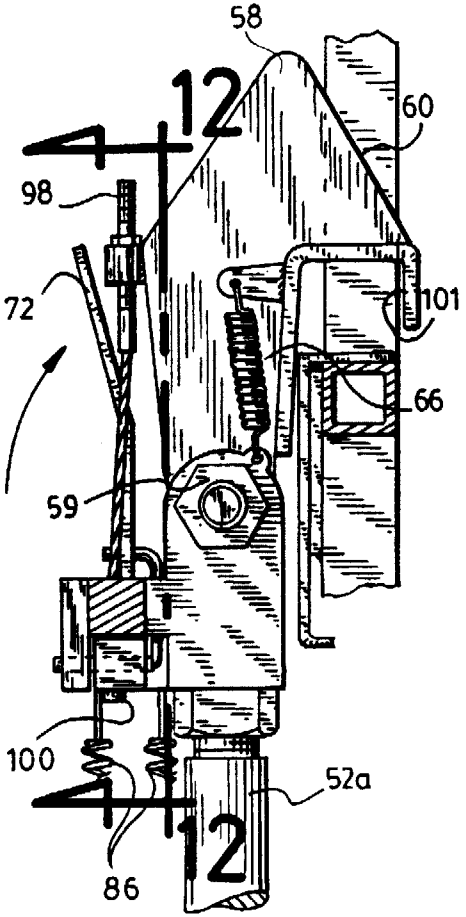

In use, to raise work platform 48, hydraulic power means 62, shown in FIG. 1 (which can be, for exampl64e, an internal combustion engine coupled to an oil pump), simultaneously activate each ram 52 in up and down movement but in alternate directions. The piston rod 52*a* of the first ram is extracted from the cylinder and the corresponding hook member 58 is moved upwardly from its initial resting position on a rung 45. Hook member 58, originally in its generally vertical hooking position, slidably engages with its inclined surface 60 each successive sliding member 64 fixed to rungs 45 (FIG. 7), being forced into its unhooking position. After sliding along sliding member 64, hook member 58 is biased to its hooking position through the instrumentality of a pair of hook springs 66, once it vertically clears the corresponding rung 45 (FIG. 8). Its extension stroke finished, the first ram 52 procedes to its retraction stroke, which will engage its hook member 58 on the rung 45 (FIG. 9). Since work platform 48 is hingedly fixed to rams 52, the retraction stroke of one or the other rams 52, 52 results in the raising of platform 48.

Since both rams 52 work simultaneously but in alternate directions, while the first ram 52 is in its extension stroke, the second ram 52 is in its retraction stroke, its hook member 58 therefore bearing on a rung 45. IC The extension stroke of one piston rod 52*a* is equal to at least slightly more than the distance between two consecutive rungs 45. Consequently, since both the extension stroke of one ram 52 and the retraction stroke of the other ram 52 are simultaneous, the work platform 48 moves upwards of a distance approximately equal to twice the distance between two consecutive rungs during one ram stroke. Also, since there always is at least one hook member 58 resting on a rung 45, work platform 48 is always prevented from falling freely along tower 40. When a hook member 58 bears on a rung 45 (fiugre 9) and that the corresponding ram 52 begins its retraction stroke, hook member 58 may pivot slightly around rung 45 due to the load sustained by ram 52. This is especially true if the rung 45 has been worn and that its corners are rounded. FIG. 9 shows that sliding member 64 will then provide a support for the bearing surface 67 of hook member 58 and that the latter will therefore abut against sliding member 64 due to the torque induced in ram 52. This torque results from the fact that ram 52 is slightly inclined, because its lower portion is attache to work platform 48 and its upper portion (hook member 58) rests on tower 40. The abutment of bearing surface 67 on sliding member 64 will facilitate the raising of work platform 48 and prevent excessive bearing of sleeve member 46 on work tower 40.

FIG. 2 shows a control handle 68, linked to hydraulic power means 62, which can be positioned in three different modes of operation: a) platform raising mode; b) platform lowering mode; and c) inactive mode. The modes are explicit, and control handle 68 therefore allows an operator to control the platform raising system 50 in any of those three modes.

FIG. 2 suggests with arrows 70*a*, 70*b* that hydraulic power means 62 are linked to rams 52. Hydraulic flow input arrow 70*a* shows where the fluid is inserted in the ram 52 that is on the verge of starting its extraction stroke, while hydraulic flow output arrow 70*b* shows the fluid output of the ram 52 that is about to begin its retraction stroke.

Figure 5:
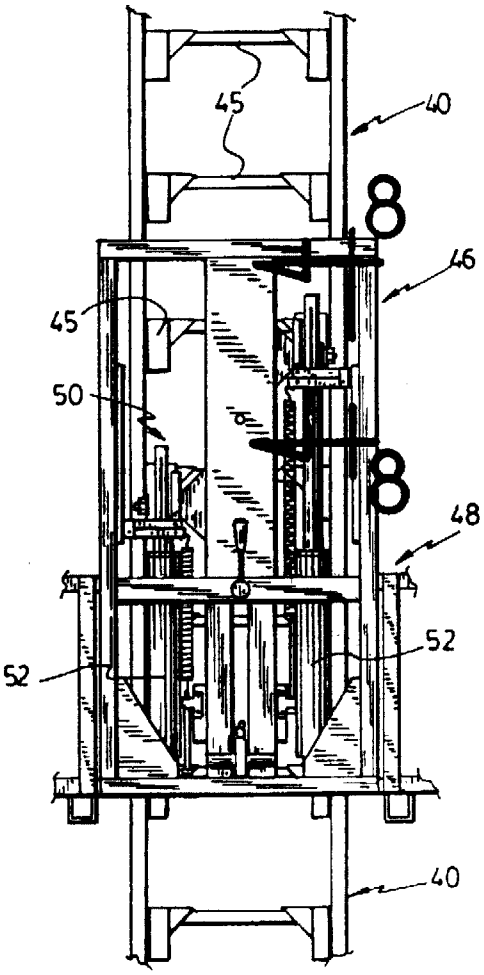
FIGS. 3 to 5 are sequential partial elevations of the tower showing the work platform and raising system at three different heights on said tower.
Figure 4:
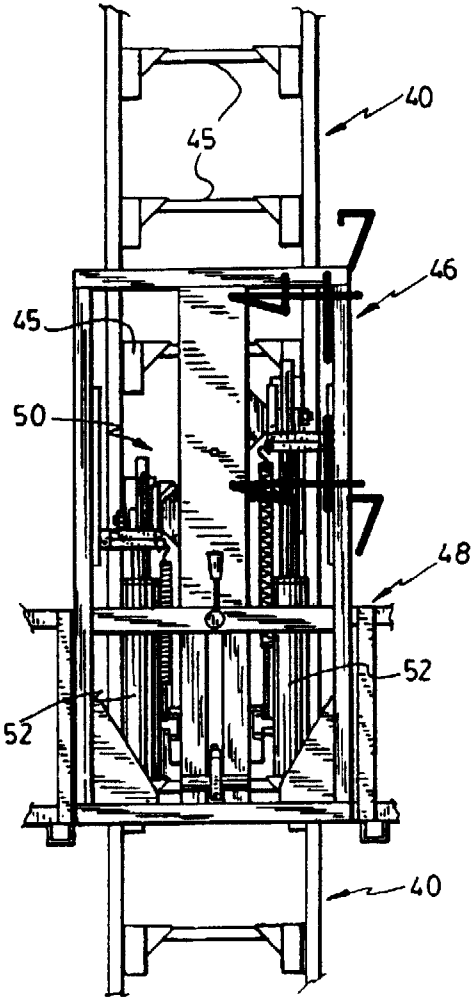
Figure 3:
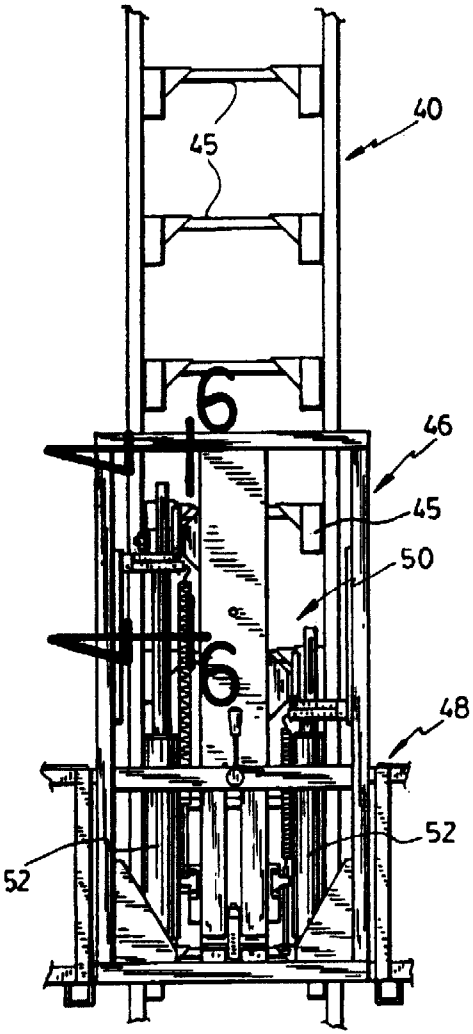

FIGS. 3 to 5 show three different consecutive positions of the sleeve member 46, work platform 48 and platform raising system 50 along a same section of tower 40. It can be seen that the rams 52, as previously stated, have an extension stroke equal to slightly more than the distance between two rungs 45, and that therefore work platform 48 moves upwards of twice the distance between two consecutive rungs 45. The upward movement of work platform 48 during this "step-by-step" operation is substantially continuous since each step is done almost immediately after the previous step is finished. Also, since the platform may be raised two rungs at a time, the platform raising system 50 is relatively faster than the conventional systems.

FIGS. 10 to 13 show that, to lower work platform 48, there is provided a latch handle 72 pivoted around a pivot screw 74 at the first end of a slider arm 76, the latter being slidably anchored at its second end in a rail 78 (FIG. 2) which is fixedly anchored to sleeve member 46. Slider arm 76 can therefore freely slide vertically along rail 78 to follow corresponding hook member 58 during each stroke of ram 52.

Figure 6:
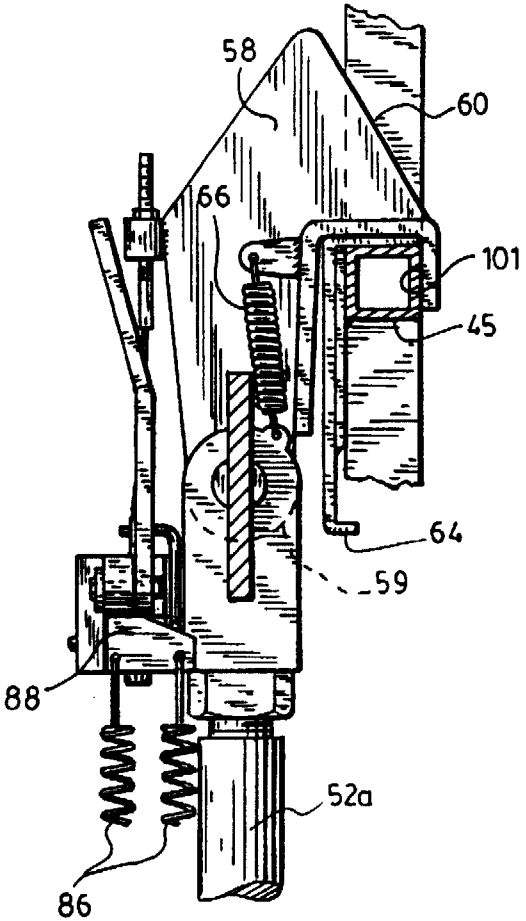
Figure 11:
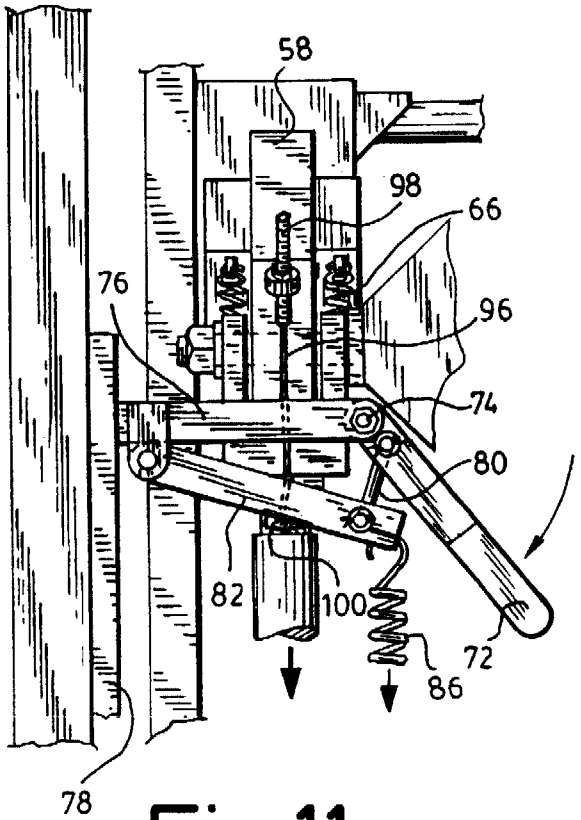
FIG. 11 is similar to FIG. 10, but showing the latching lever member in its unlatched position.

When latch handle 72 is pivoted downwardly by an operator, as suggested in FIGS. 11 and 13, a U-shaped link 80 pivots a latch lever member 82 generally downwardly around a pivot pin 84 from its latched position to its unlatched position. Indeed, FIG. 14 shows that the first and second legs 80*a* and 80*b* of U-shaped link 80 are rotatably attached to latch handle 72 and to latch lever member 82, respectively. First leg 80*a* is attached non-coaxialy relative to pivot screw 74 on latch handle 72 so as to provoke the generally downward movement of its second leg 80*b* around pivot pin 84, therefore forcing latch lever member 82 into its unlatched position If there is no pressure applied on latch handle 72 by an operator, the position of latch lever member 82 will depend on the state of a pair of springs 86, 86. FIGS. 2 and 6 show that springs 86 are attached at their upper end to a spring plate 88 (FIG. 6) and at their lower end to a respective piston 90 which is slidably and vertically movable inside a bored piston guide 92 fixedly but adjustably attached to a vertical beam 94 of sleeve member 46 structure.

Figure 10:
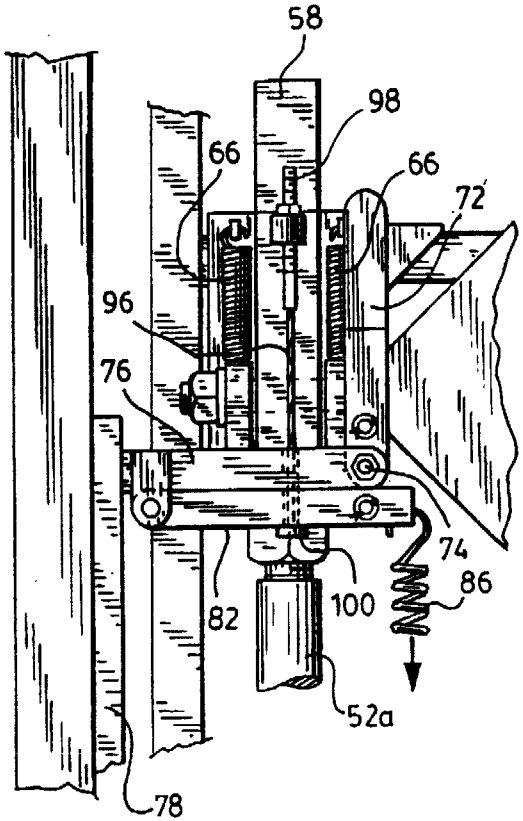
FIG. 10 is an elevation, at an enlarged scale, taken in the area circumscribed in line 10 of FIG. 1.

If latch handle 72 is not pivoted downwardly, link 80 will keep latch lever member 82 in its latched position (FIGS. 10 and 12).

FIGS. 10 to 13 show a wire 96 adjustably attached, e.g. by means of a set screw 98, at its first extremity to hook member 58 and passing through bores in slider arm 76 and in latch lever member 82. A retainer cap 100 is fixed at the second extremity of wire 96, under latch lever member 82. Since hook springs 66 tend to keep hook member 58 in its hooking position, wire 96 will pull on retainer cap 100 and contribute to keep latch lever member 82 in its latched position. When hook member 58 pivots into its unhooking position (FIG. 7) since link 80 keeps latch lever member 82 in its latched position, wire 96 will be free to move downwardly under the (less than consedirable) weight of retainer cap 100.

However, if latch handle 72 is pivoted downwardly, latch lever member 82 will be free to move from its latched position to its unlatched position. When the piston rod 52*a* of corresponding ram 52 is retracted (as the right hand ram 52 of FIG. 2), there is no tension in spring 86 and hook member 58 will be kept in its hooking position by hook springs 66, therefore forcing with wire 96 latch lever member 82 into its latched position. When piston rod 52*a* is gradually extracted, hook member 58 moves upwardly and piston 90 will slide correspondingly upwards in piston guide 92, until its lower end equipped with a radial flange 90*a* abuts against piston guide 92, near the one third of the course of piston rod 52*a*. For the rest of the piston rod extraction, spring 86 will be gradually stretched and it will apply a downward force on latch lever member 82, thus applying a pressure to pivot hook member 58 into its unhooking position through the instrumentality of wire 96.

Therefore, when latch handle 72 is kept in its upwardly oriented position, springs 86 have no effect whatsoever. But when latch handle 72 is pivoted downwardly, hook member 58 will be pivoted into its unhooking position unless it already engages a rung 45 which would prevent this. Indeed, FIG. 9 shows that the retaining surface 101 (by abutting on rung 45) of hook member 58 prevents the latter from pivoting to its unhooking position. Thus, when the operator desires work platform 48 to move downwardly, he pivots both latch handles 72, 72 downwardly and he positions control handle 68 to its platform lowering mode. When a ram 52 engages with its hook member 58 a rung 45, the hook member 58 of the other ram 52 still engages the next upper rung 45 and, an instant later, as this second ram 52 extracts its piston rod 52*a* even more, hook member 58 vertically clears this rung 45 and is free to pivot to its unhooking position under the action of corresponding springs 86, 86. Ram 52 is then free to procede to the retraction of its piston rod, since hook member 58 will then not hinder its downward movement because hook member 58 is in its unhooking position which clears rungs 45. When spring 86 ceases to apply pressure because it is unextended (near the one third of its course and after clearing two consecutive rungs 45), hook member 58 regains its hooking position well before it engages a rung 45. The downward movement of work platform 48 is therefore accomplished without the constant intervention of the operator.

To move work platform 48 upwards, the operator must pivot both latch handles 72 into their upwardly oriented position (FIG. 10) and position control handle 68 in its platform raising mode.

Figure 15:
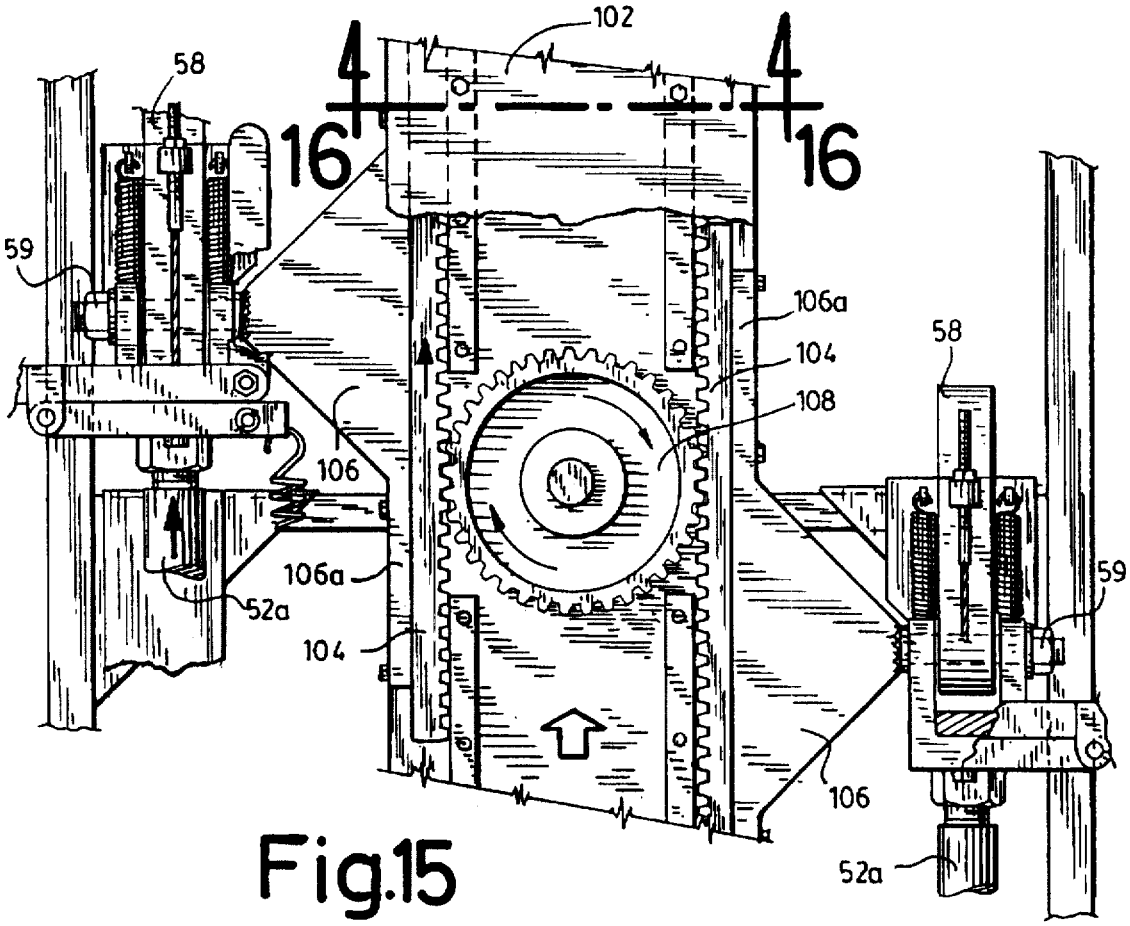
FIG. 15 is a partial fragmented elevation, at an enlarged scale, of the raising system of FIGS. 1 and 2, showing more particularly the toothed racks and the gear wheel of the invention.
Figure 16:
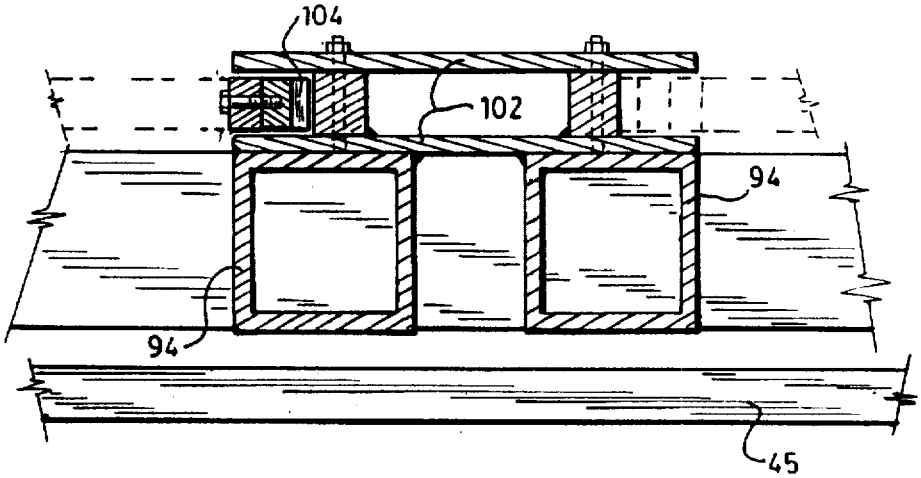
FIG. 16 is a partial cross-sectional view, at an enlarged scale, taken along line 16—16 of FIG. 15.

FIG. 2 shows that vertical beams 94 hold a gear housing 102. FIG. 15 shows that gear housing 102 houses two slidable toothed racks 104, 104, which are fixedly attached (e.g. welded) by means of a rack plate 106 to a corresponding hook bolt 59, and a complementary gear wheel 108. Rack plates 106 have a generally triangular shape and have flanges 106*a* extending along racks 104 to allow bolting of one to the other. Housing 102 has openings on its sides to allow rack plates 106 to extend outwardly therefrom (FIG. 16).

The racks 104 and gear wheel 106 assembly synchronizes the relative movement of hook members 58, 58 to prevent them from being unattuned with one another, which would of course mean that the platform raising system 50 would be inoperable. Both hook members 58 therefore always stay in registration with one another.

Figure 19:
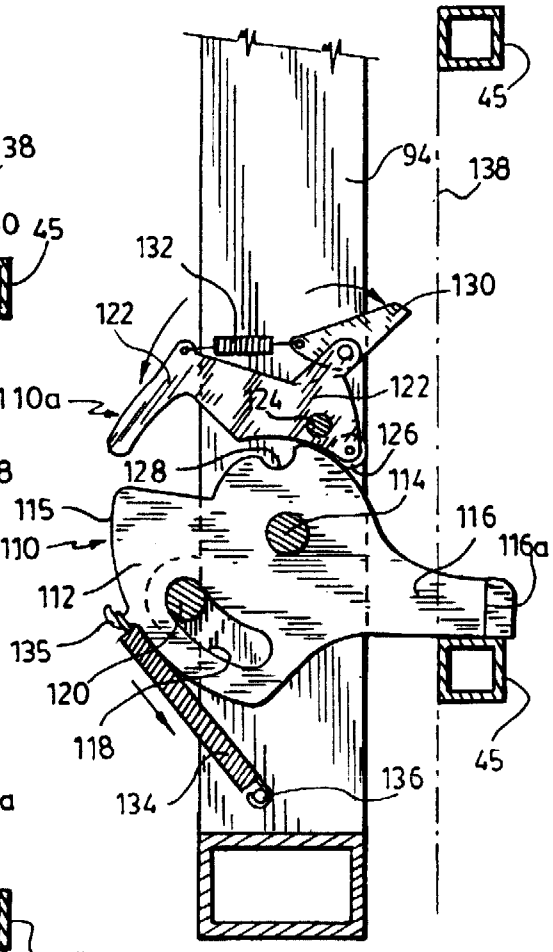
FIGS. 18 and 19 are similar to FIG. 17, but the security braking system is in different sequential positions.

FIGS. 17 to 20 show a security braking system 110 installed between the two vertical beams 94 of sleeve member 46 (FIG. 2). Braking system 110 comprises a rocking member 112 which can pivot around a holding pin 114 between a rung clearing position (FIG. 17) and a rung engaging position (FIG. 19). Rocking member 112 has a sectorial edge 115 and a blocking arm 116 having a T-shaped cross-section at its free extremity 116*a* (FIG. 20) and extending opposite sectorial edge 115 on rocking member 112, T-shaped extremity 116*a* being a counterweight for the rest of rocking member 112. A concentric arcuate slot 118 is provided near sectorial edge 115 through which a blocking pin 120 is slidable. The rung engaging and rung clearing positions are defined by the corresponding limit positions of rocking member 112 sliding around blocking pin 120 between the two positions in which the extremities of arcuate slot 118 abuts against blocking pin 120.

Braking system 110 further comprises a retainer arm 122 positioned over rocking arm 112 and pivotable around an arm pin 124. Retainer arm 122 has a wheel 126 near arm pin 124 which engages a complementary widthwise groove 128 in rocking member 112 when it is in the rung clearing position. A finger 130 is pivotably installed on retainer arm 122 generally opposite wheel 126 relative to arm pin 124, a finger spring 132 also linking it to retainer arm 122.

A tension spring 134 is hooked to a hook 135 protruding from sectorial edge 115 of rocking member 112 at its first extremity and to a spring pin 136 fixed to vertical beams 94, 94 at its second extremity. Tension spring 134 is stretched when rocking member 112 is in its rung clearing position, and lengthwisely paritally bears on sectorial edge 115 of rocking member 112.

Figure 18:
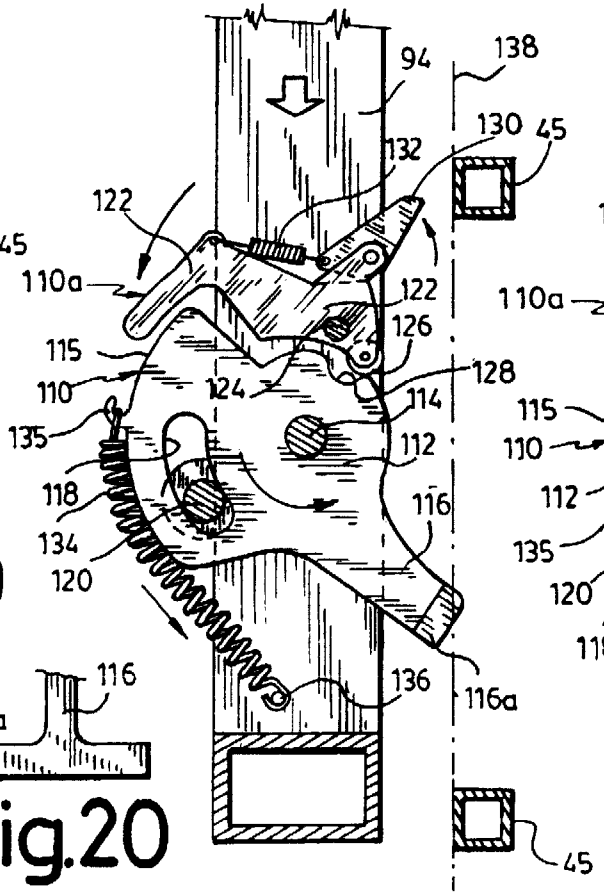
Figure 20:
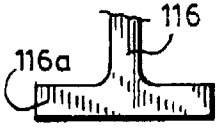
FIG. 20 is a cross-sectional view taken along line 20—20 of FIG. 17.
Figure 17:
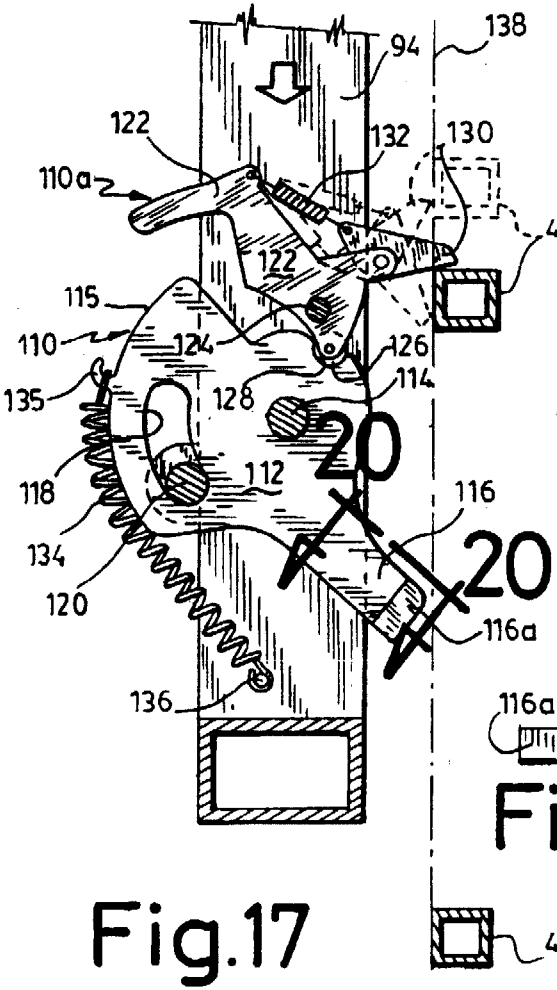
FIG. 17 is a partial cross-sectional view, at an enlarged scale, taken along line 17—17 of FIG. 2, showing the security braking system.

In use, finger spring 132 is in its equilibrium state when finger 130 is between two rungs 45 (FIG. 17 in full lines), the free extremity of finger 130 then extending beyond the vertical plane of rungs 45 shown in FIGS. 17 to 19 by axis 138: finger 130 is then in its rung engaging position. When sleeve member 46 is lowered at a normal (relatively slow) rate, finger 130 will hit smoothly each successive rung 45 and pivot upwardly until rung 45 is cleared (FIG. 17 in dotted lines). Finger spring 132 will pivot finger 130 back into its rung engaging position afterwards. When sleeve member 46 is raised, finger 130 will hit smoothly each successive rung 45 and pivot downwardly until rung 45 is cleared (FIG. 17 in dottes lines). Again, finger spring 132 will pivot finger 130 back in its rung engaging position afterwards.

If sleeve member 46 was to descend abnormally fast (i.e. falling) as suggested in FIGS. 18 and 19, finger 130 would hit the next rung 45 at high speed, relative to the usual lowering rate, and it would tilt backwards suddenly. The force of this sudden backward movement would be transmitted to retainer arm 130 which would in turn pivot counterclockwisely as suggested in FIGS. 18 and 19. Indeed, wheel 126 would then apply a generally downward pressure on groove 128 which would slightly pivot rocking arm 112 and allow wheel 126 to disengage groove 128 (FIG. 18). Tension spring 136 would then pivot rocking arm 112, as suggested with an arrow in FIG. 18, from its rung clearing position until the latter reaches its rung engaging position (FIG. 19). Once wheel 126 disengages groove 128, the inertia of counterweight free extremity 116*a* of blocking arm 116 will also contribute to pivot rocking arm 112.

When the next rung 45 is encountered, blocking arm 116, now in the rung engaging position and therefore extending beyond plane 138, will abut against this rung 45 (figuer 19) and stop the fall of sleeve member 46.

Figures 21, 22:
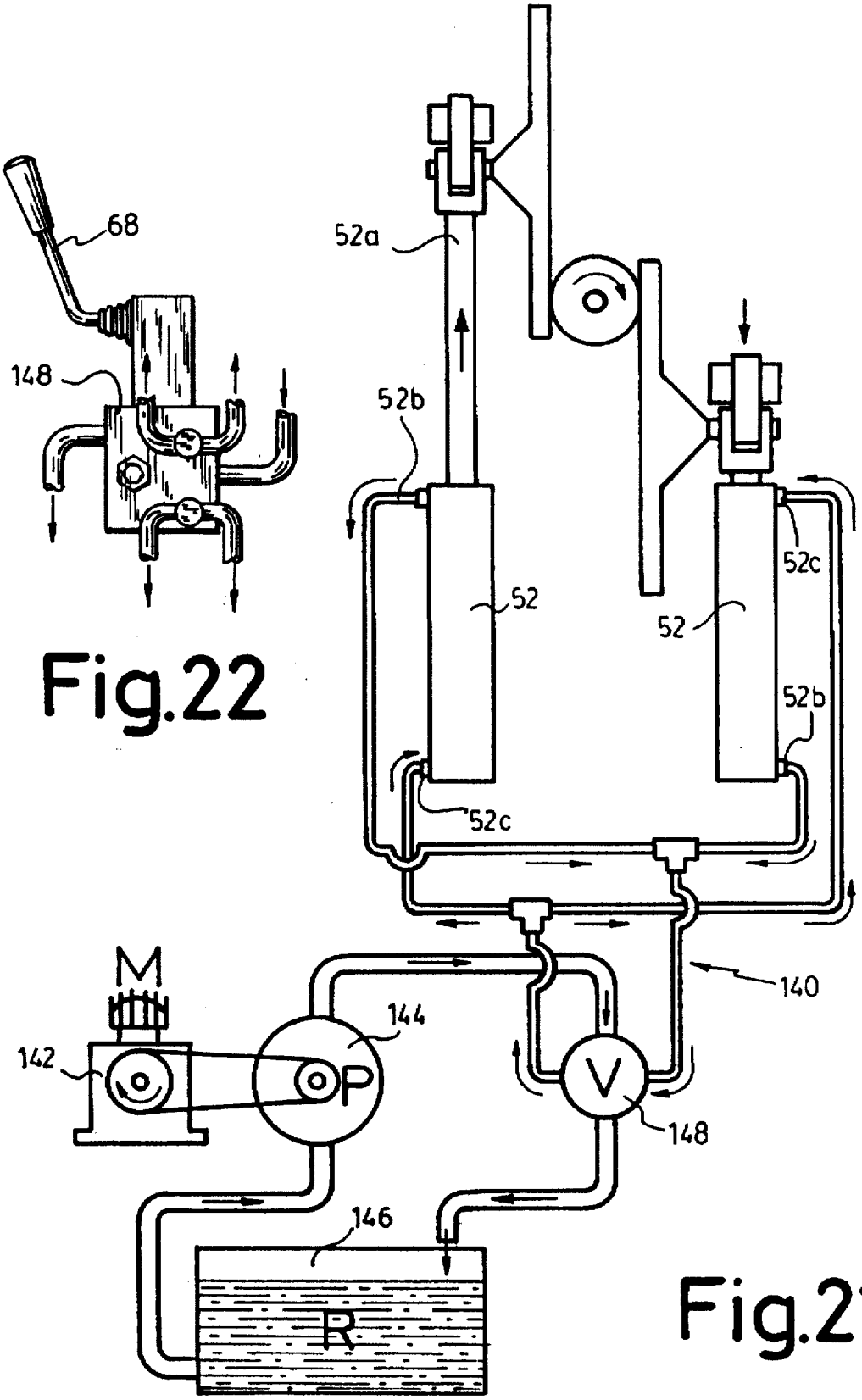
FIG. 21 a schematic view of the hydraulic circuit of the platform raising system of the invention.
FIG. 22 is a side view of the control handle and the corresponding hydraulic connections therewith.
Figure 26:
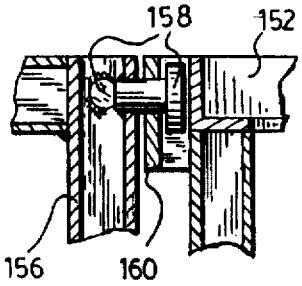
FIG. 26 is a cross-sectional view taken along line 26—26 of FIG. 25.

FIG. 21 shows the hydraulic circuit 140 of platform raising system 50. There is provided a motor 142 (internal combustion or otherwise) linked to a pump 144 which feeds circuit 140 with the proper fluid (e.g. oil) from a supply reservoir 146. The fluid will be fed simultaneously to each ram 52, but the hydraulic flow input will be fed alternately to the upper and lower circuit connections 52*b* and 52*c*, respectively, of rams 52, which will result, as is known in the art, in the alternate movement of the piston rods 52*a* of rams 52. A flow controler 148 will determine, through the instrumentality of control handle 68 (FIG. 22), the direction of the flow, which in turn will determine wether the sleeve member is raised or lowered.

Figure 23:
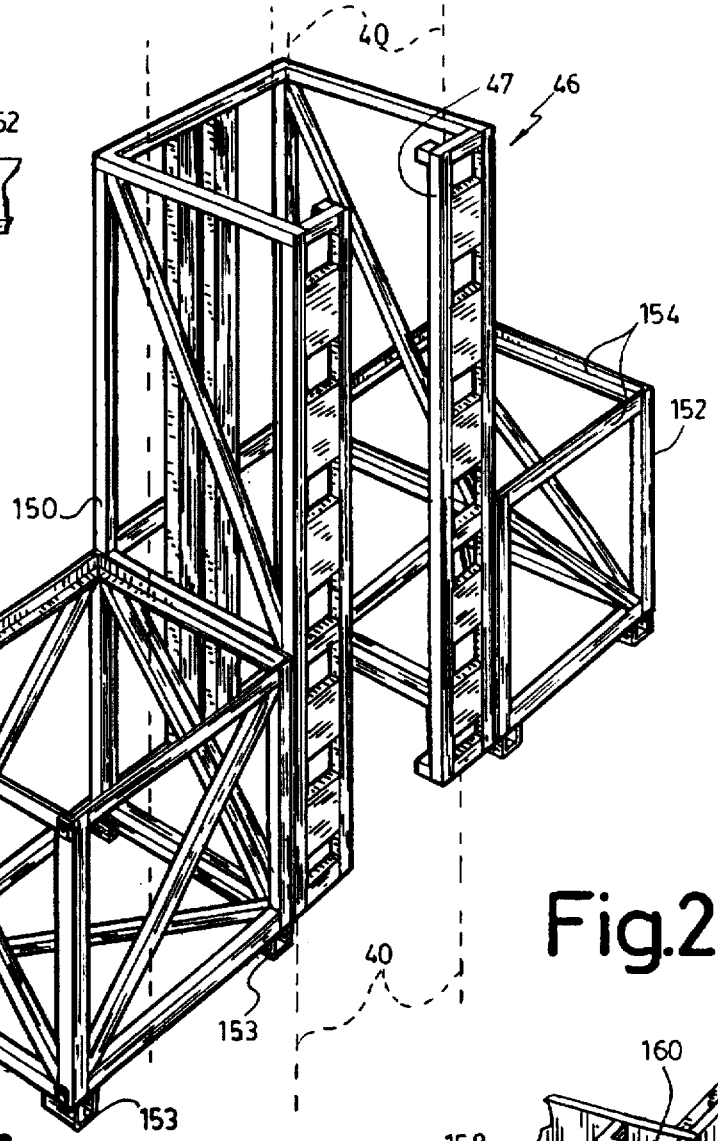
FIG. 23 is a perspective view of the sleeve member that is destined to move along the tower, the position of the latter being suggested in dotted lines.
Figure 25:
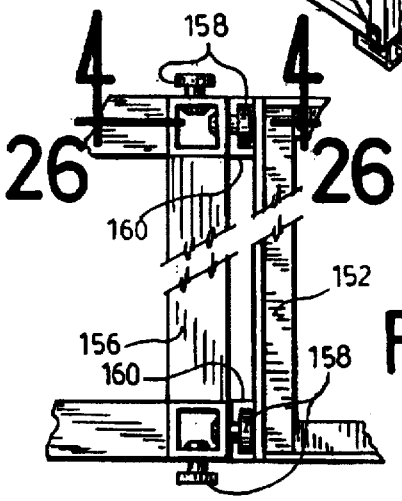
FIG. 25 is a top plan view of modular attachment means.
Figure 24:
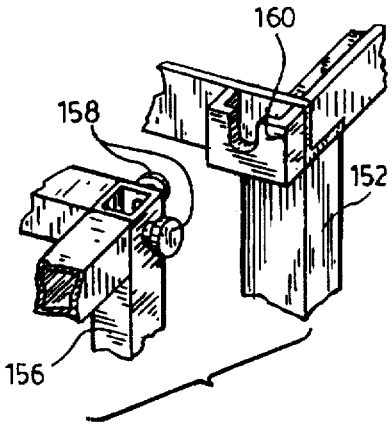
FIG. 24 is a perpective view, at an enlarged scale, of the attachment means for the modular work platform.

A basic form of sleeve member 46 is shown in FIG. 23. This sleeve member has a central sleeve 150 and one generally cubic side structure 152 on each side of central sleeve 150. Each side structure 152 has a plurality of joists and cross bars, as is detailed in the previously cited patents. Under each side structure 152 are fixedly attached rectangular tubes 153 for slidably inserting complementary rectangular support rods (not shown). On these support rods a platform can be removably installed for supporting workmen. A second and a third platform (not shown) can also be installed on sleeve member 46, on the top bars 154 of side structures 152, for supporting equipment used by the workmen at a height that would be easily reachable without having to bend down.

To the basic sleeve member 46 can be added a plurality of strucural module members 156 (FIGS. 24 to 26) that are similar to the cubic side structures 152, 152. FIGS. 23 to 26 show that these module members can be removably installed on the outer end of side structures 152, 152 by means of hooking members 158 slidably engageable into complementary hook casings 160. Any number of these module members 156 can be added to the basic sleeve member 46 (up to the structural capacity limit of the material being used, of course) since every module member 156 is equipped with hooking members 158 on one side and with hook casings 160 on the other.

It is understood that sleeve member 46 and all module members 156 attached thereto must be of approximately equally distributed weight and approximately symmetrically installed relative to tower 40, so as to be generally balanced and not induce important stresses in tower 40 due to lateral tilting of the latter.

Figure 27:
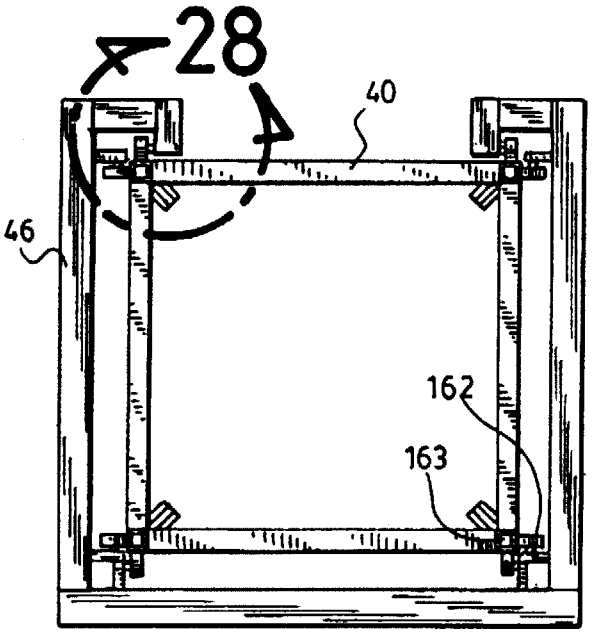
FIG. 27 is a cross-sectional view, at an enlarged scale, taken along line 27—27 of FIG. 1.
Figure 28:
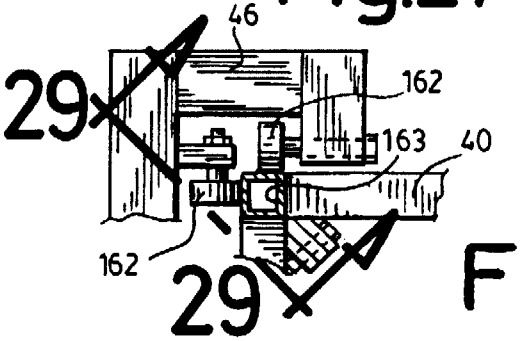
FIG. 28 is a view, at an enlarged scale, of the area circumscribed in circle 28 of FIG. 27.

FIG. 27 shows the tower 40 and sleeve member 46 engagement. It can be seen in FIGS. 27 to 29 that idle rollers 162 are installed on the inner side of sleeve member 46 to rotatably abut against the outer side of tower 40 on its corner tower posts 163 to prevent sleeve member 46 from moving in any direction except along tower 40.

Figure 30:
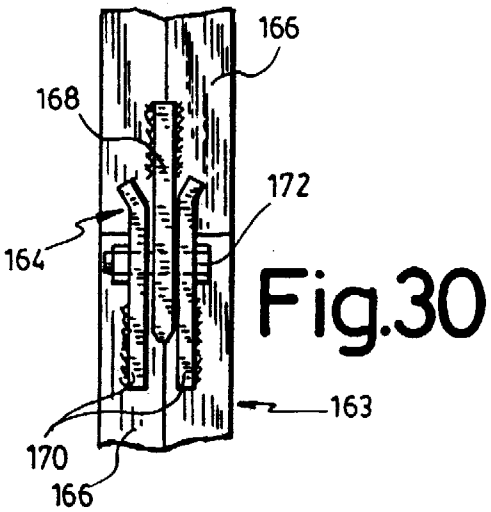
FIG. 30 is a partial edge view of a tower post, at an enlarged scale, showing the modular attachment means of the tower.
Figure 31:
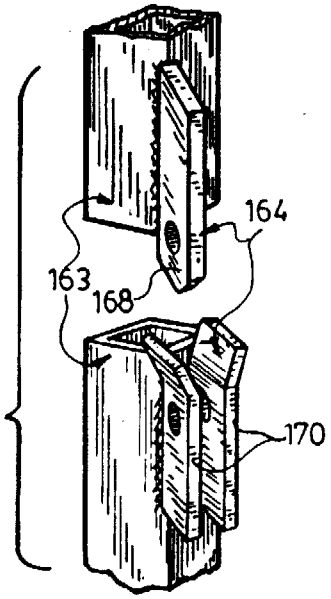
FIG. 31 is an exploded perspective view of the modular attachment means of FIG. 30.
Figure 29:
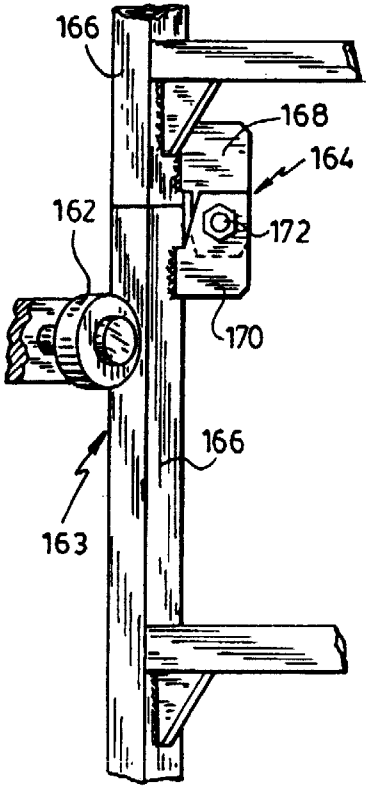
FIG. 29 is a cross-sectional view taken along line 29—29 of FIG. 28.

FIGS. 29 to 31 show that tower 40 is modular. Indeed, attachment means 164 are provided to fixedly attach two tower modules 166 to one another. With this modular tower 40, the height of the tower can be easily adjusted by the workmen. Attachment means 164 can be, for example, of the type shown in FIGS. 30 and 31, comprising a slider plate 168 slidably engaging a pair of parallel receiving plates 170, 170 and fixed thereto by means of a bolt 172.

We claim:

1. A platform raising system in a scaffolding for raising a work platform along a tower, said platform being sustained by a sleeve member positioned around said tower, almost encircling it completely, said sleeve member being movable along said tower, said tower having a plurality of approximately parallel and equally spaced rungs, said raising system being installed on said sleeve member, said raising system comprising two rams pivotably attached to said sleeve member and having piston rods movable from a retracted position to an extracted position and at the end of which are pivotably installed corresponding hook members, said rams being connected to power means and control means that simultaneously activate each ram in up and down movement but in alternate directions, first pivoting means for pivoting said hook members from a hooking position to an unhooking position under the action of said rams, said raising system further comprising synchronizing means for synchronizing the relative movement of said rams, at least one of said hook members abutting against one of said rungs in said hooking position at any given time to sustain said sleeve member, said raising system further comprising second pivoting means for pivoting said hook members from said hooking position to said unhooking position, said second pivoting means comprising a latch lever member pivotable between a latched position and an unlatched position, said second pivoting means being gradually activated during the extension stroke of said rams from an inactive position when said piston rods are in said retracted position, said second pivoting means pivoting one of said hook members only if: a) said hook member is not bearing on any one of said rungs in a hooking engagement; and b) said latch lever member is in said unlatched position.

2. A platform raising system as defined in claim 1, wherein said sleeve member is raised or lowered of a distance approximately equal to twice the distance between two successive rungs under the action of said rams, the strokes of said rams being at least equal to slightly more than the distance between two successive rungs.

3. A platform raising system as defined in claim 1, wherein said first pivoting means are inclined surfaces on said hook members, said inclined surfaces being slidably engageable with each successive rung to pivot said hook members in said unhooking position.

4. A platform raising system as defined in claim 3, wherein said hook members have biasing means for pivoting them from said unhooking position to said hooking position when said inclined surface is not in contact with one of said rungs.

5. A platform raising system as defined in claim 1, wherein a latch handle is provided to manually force said latch lever member into said latched position or into said unlatched position.

6. A platform raising system as defined in claim 1, wherein said second pivoting means further comprise at least one spring for each of said rams, said spring being attached to a corresponding one of said hook members at its first extremity and to said sleeve member at its second extremity, said spring being at its equilibrium state when said corresponding piston rod is in said retracted position.

7. A platform raising system as defined in claim 6, wherein said hook members have biasing means for pivoting them from said unhooking position to said hooking position when said second pivoting means are not pivoting them into said unhooking position.

8. A platform raising system as defined in claim 1, wherein said synchronizing means are a pair of parallel toothed racks engaging peripherally a complementary gear wheel on opposite sides of the latter, each one of said racks being rigidly linked to a corresponding one of said hook members.

9. A platform raising system as defined in claim 1, further comprising a security braking system, said braking system to be activated only if said sleeve member moves generally downwardly along said tower at a specific speed or faster, said specific speed being considerably faster than the speed at which the sleeve member is destined to move along said tower during its use.

10. A platform raising system as defined in claim 9, wherein said braking system comprises a rocking member pivotable between a rung engaging and a rung clearing position, a retainer arm pivotable between a first and a second limit position, said retainer arm retaining said rocking member in said rung clearing position when it is in said first limit position, biasing means for pivoting said rocking member in said rung engaging position when said retainer arm is in said second limit position and a finger member for pivotable abutment against each of said successive rungs, said finger member pivoting on itself when the speed of said sleeve member is lower than said specific speed and pivoting said retainer arm from said first limit position to said second limit position when the speed of said sleeve member is greater than said specific speed.

11. A scaffolding comprising a tower and work platform, said work platform being sustained by a sleeve member positioned around said tower, almost encircling it completely, said sleeve member being movable along said tower, said tower having a plurality of approximately parallel and equally spaced rungs, said scaffolding further comprising a raising system being installed on said sleeve member, said raising system comprising two rams pivotably attached to said sleeve member and having piston rods movable from a retracted position to an extracted position and at the end of which are pivotably installed corresponding hook members, said rams being connected to power means and control means that simultaneously activate each ram in up and down movement but in alternate directions, first pivoting means for pivoting said hook members from a hooking position to an unhooking position under the action of said rams, said raising system further comprising synchronizing means for synchronizing the relative movement of said rams, at least one of said hook members abutting against one of said rungs in said hooking position at any given time to sustain said sleeve member, said scaffolding further comprising second pivoting means for pivoting said hook members from said hooking position to said unhooking position, said second pivoting means comprising a latch lever member pivotable between a latched position and an unlatched position, said second pivoting means being gradually activated during the extension stroke of said rams from an inactive position when said piston rods are in said retracted position, said second pivoting means pivoting one of said hook members only if: a) said hook member is not bearing on any one of said rungs in a hooking engagement; and b) said latch lever member is in said unlatched position; a latch handle being provided to manually force said latch lever member into said latched position or into said unlatched position, said second pivoting means further comprising at least one spring for each of said rams, said spring being attached to a corresponding one of said hook members at its first extremity and to said sleeve member at its second extremity, said spring being at its equilibrium state when said corresponding piston rod is in said retracted position, said hook members having biasing means for pivoting them from said unhooking position to said hooking position when said second pivoting means are not pivoting them into said unhooking position.

12. A scaffolding as defined in claim 11, wherein said synchronizing means are a pair of parallel toothed racks engaging peripherally a complementary gear wheel on opposite sides of the latter, each one of said racks being rigidly linked to a corresponding one of said hook members.

13. A scaffolding as defined in claim 11, further comprising a security braking system, said braking system to be activated only if said sleeve member moves generally downwardly along said tower at a specific speed or faster, said specific speed being considerably faster than the speed at which the sleeve member is destined to move along said tower during its use, said braking system comprising a rocking member pivotable between a rung engaging and a rung clearing position, a retainer arm pivotable between a first and a second limit position, said retainer arm retaining said rocking member in said rung clearing position when it is in said first limit position, biasing means for pivoting said rocking member in said rung engaging position when said retainer arm is in said second limit position and a finger member for pivotable abutment against each of said successive rungs, said finger member pivoting on itself when the speed of said sleeve member is lower than said specific speed and pivoting said retainer arm from said first limit position to said second limit position when the speed of said sleeve member is greater than said specific speed.

14. A scaffolding as defined in claim 11, wherein said sleeve member comprises a basic sleeve member and can include a plurality of module members, said module members being removably attachable to said basic sleeve member, said basic sleeve member and said module members attached thereto being of approximately equally distributed weight and being approximately symmetrically installed relative to said tower.

15. A scaffolding as defined in claim 11, wherein said tower comprises a plurality of tower modules removably and fixedly resting on one another.

* * * * *